US006167647B1

(12) United States Patent
Yang

(10) Patent No.: US 6,167,647 B1
(45) Date of Patent: Jan. 2, 2001

(54) DOUBLE-DIRECTIONAL ROTARY WATER BALL STRUCTURE

(75) Inventor: Shin-Ya Yang, Hsin Tien (TW)

(73) Assignee: Ya Yung Enterprise Co., Ltd., Taipei Hsien (TW)

( * ) Notice: Under 35 U.S.C. 154(b), the term of this patent shall be extended for 0 days.

(21) Appl. No.: 09/265,634

(22) Filed: Mar. 10, 1999

(51) Int. Cl.[7] ..... G09F 19/00
(52) U.S. Cl. ..... 40/430; 40/409
(58) Field of Search ..... 40/430, 409

(56) References Cited

U.S. PATENT DOCUMENTS 5,701,785 * 12/1997 Liu ..... 40/430
5,896,687 * 4/1999 Lo ..... 40/409

* cited by examiner

*Primary Examiner*—Cassandra Davis
(74) *Attorney, Agent, or Firm*—Pro-Techtor International Services

(57) ABSTRACT

A double-directional rotary water ball structure in which a music bell is disposed in a base seat of the water ball and a transmission shaft extends from the music bell for outputting rotational power. A driving gear is fitted with the transmission shaft for transmitting the power respectively to a central driven gear and an inner gear disposed on inner circumference of a rotary tray. Accordingly, the rotary tray and a transmission claw connected to the driven gear are respectively driven to rotate in reverse directions, whereby the internal view of the water ball and the external view disposed on the rotary tray are rotated in reverse directions so as to create a double-directional rotation visual effect.

1 Claim, 5 Drawing Sheets

DOUBLE-DIRECTIONAL ROTARY WATER BALL STRUCTURE

BACKGROUND OF THE INVENTION

The present invention relates to a double-directional rotary water ball structure in which a specific transmission mechanism is disposed in a base seat of the water ball, whereby an internal view of the water ball and an external view disposed on outer side of the base seat are rotated in reverse directions so as to create a double-directional rotation visual effect.

A watching water ball is designed with internal dynamic view which is rotatable with a music bell so as to create a visual entertaining effect. However, the existing commercially available water ball products are varied from each other only in the internal view design and rotational direction. The water balls are rarely entirely changed.

SUMMARY OF THE INVENTION

It is therefore a primary object of the present invention to provide a double-directional rotary water ball which has simple and compact structure and can be easily and quickly assembled and disassembled. The water ball is manufactured at low cost without easy damage.

In order to achieve the above object, the water ball structure of the present invention includes a base seat and a music bell disposed in the base seat. A transmission shaft extends from the music bell for outputting rotational power. A driving gear is fitted with the transmission shaft for transmitting the power respectively to a central driven gear and an inner gear disposed on inner circumference of a rotary tray. Accordingly, the rotary tray and a transmission claw connected to the driven gear are respectively driven to rotate in reverse directions, whereby the internal view of the water ball and the external view disposed on the rotary tray are rotated in reverse directions so as to create a double-directional rotation visual effect.

The present invention can be best understood through the following description and accompanying drawings, wherein:

DETAILED DESCRIPTION OF THE PREFERRED EMBODIMENT

Figure 1:
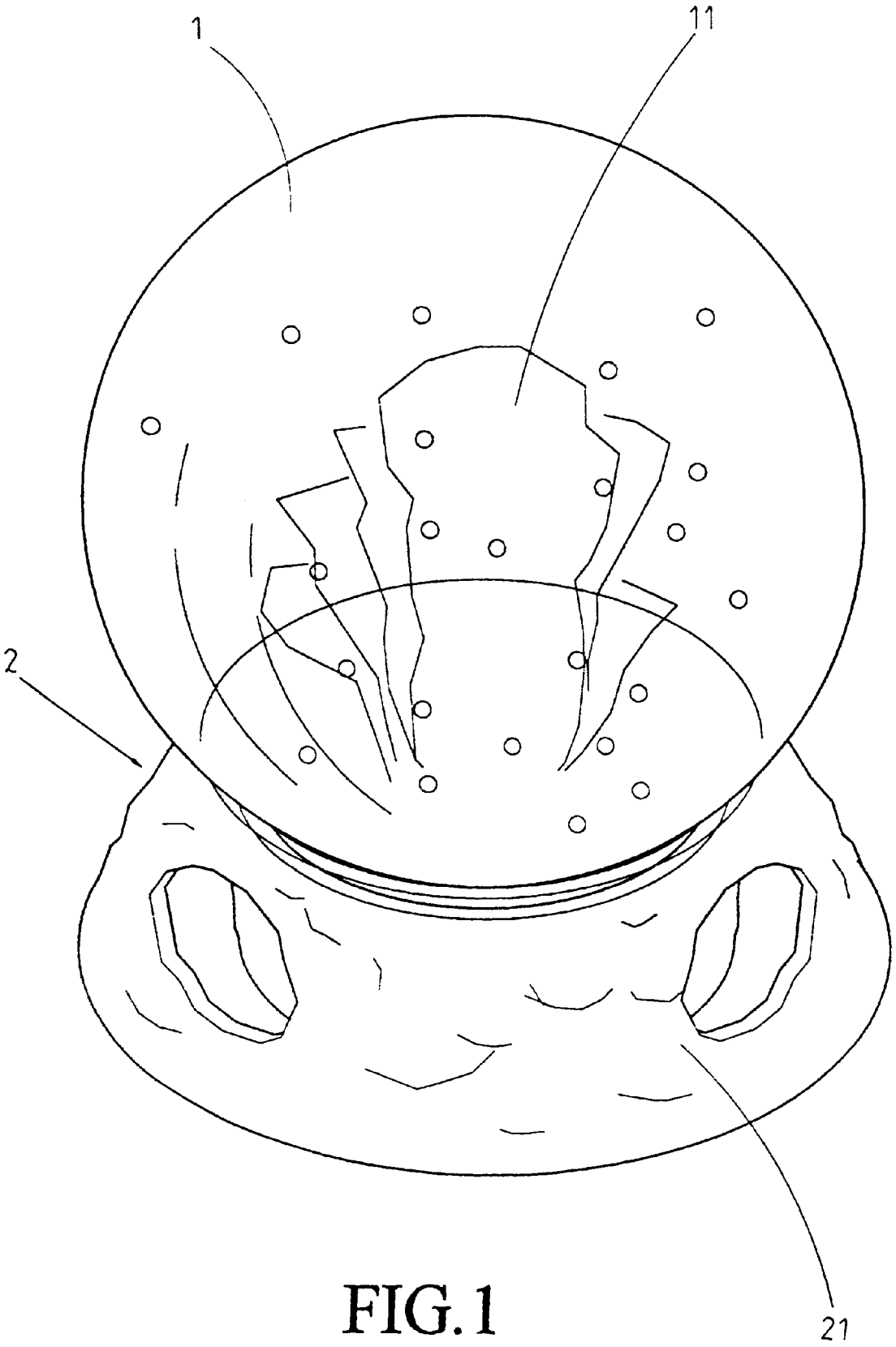
FIG. 1 is a perspective view of the present invention, showing the appearance of the water ball thereof.
Figure 2:
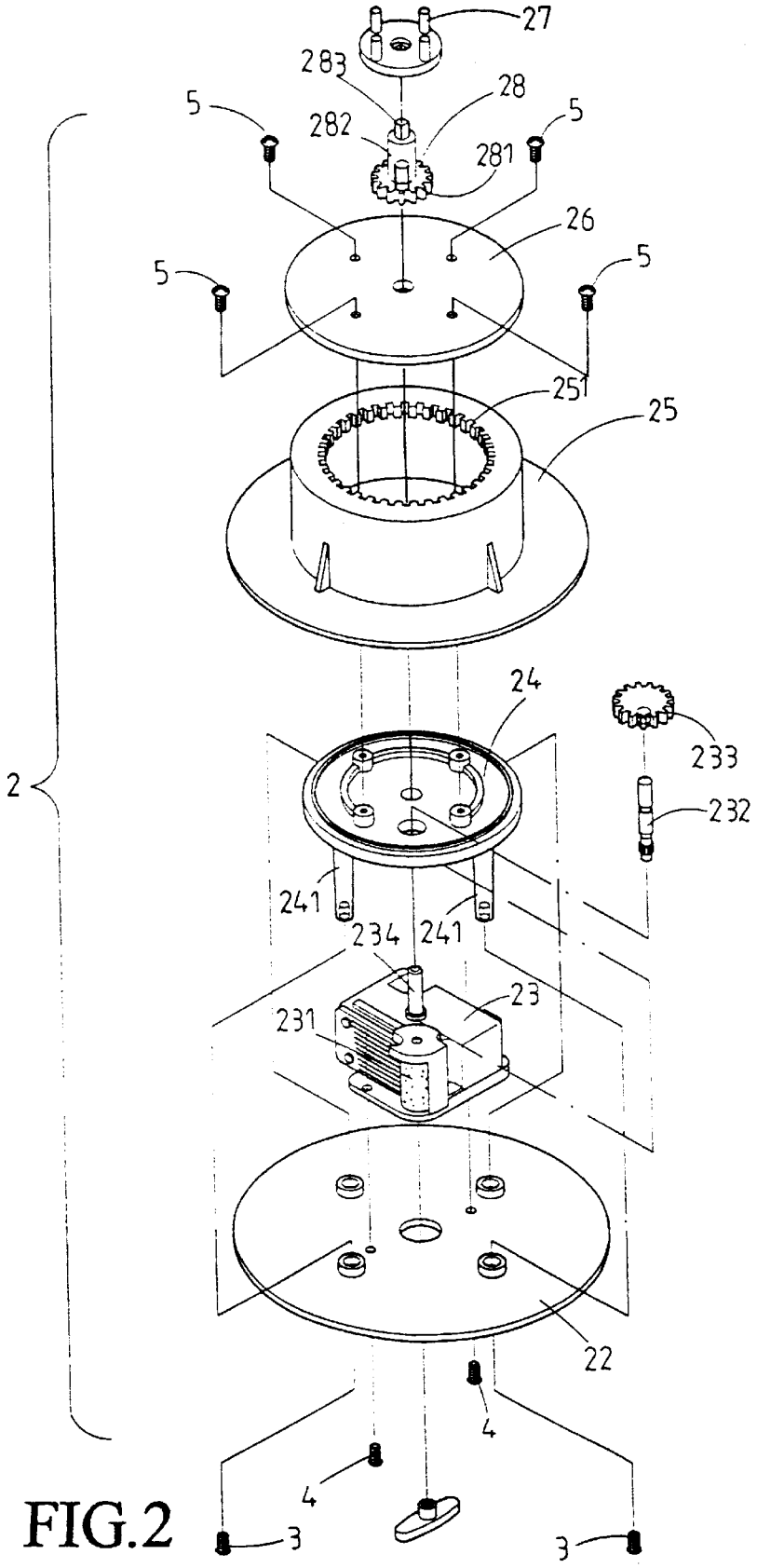
FIG. 2 is a perspective exploded view of the base seat of the present invention.
Figure 3:
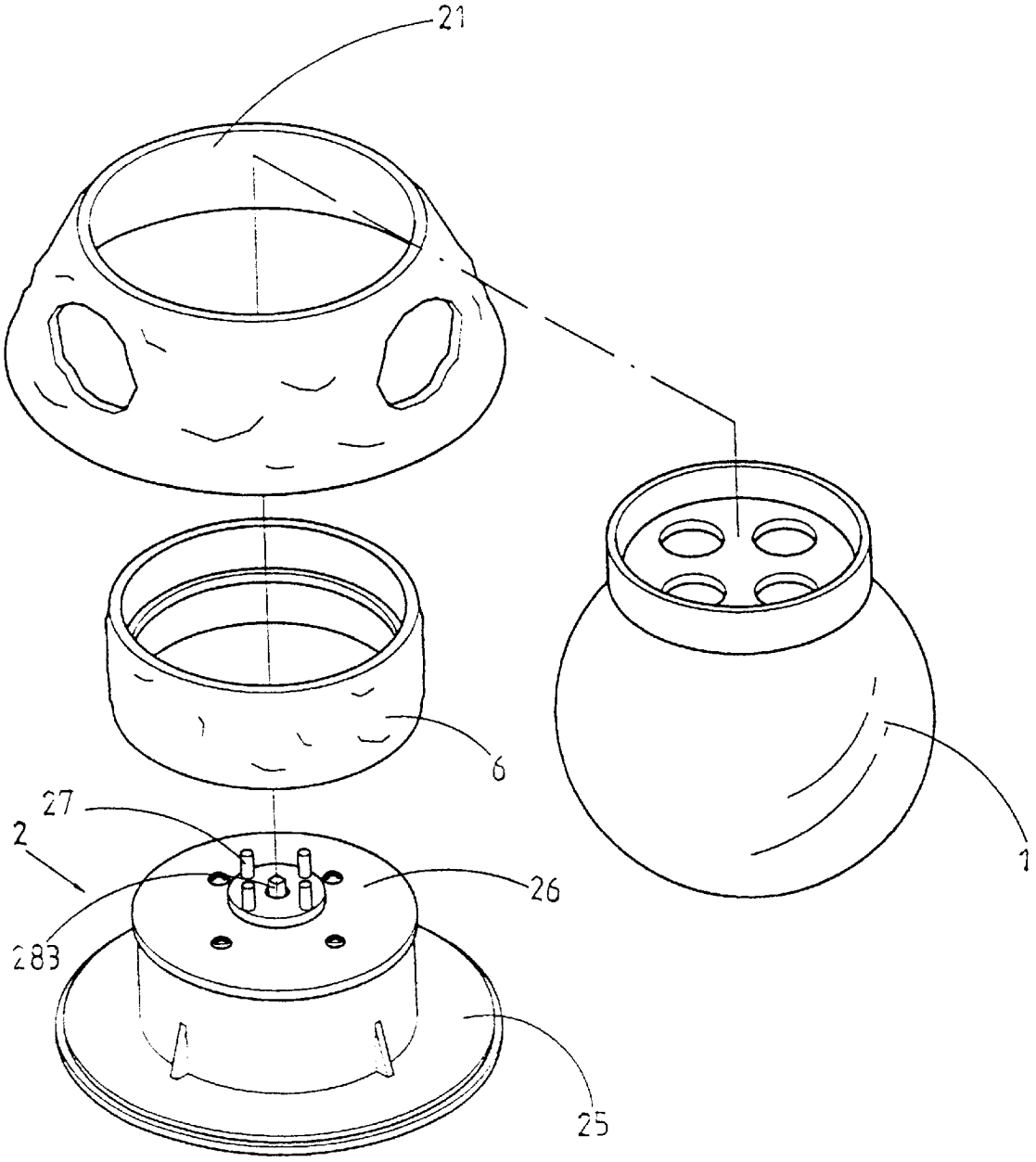
FIG. 3 is a perspective exploded view of the water ball and the base seat of the present invention.
Figure 4:
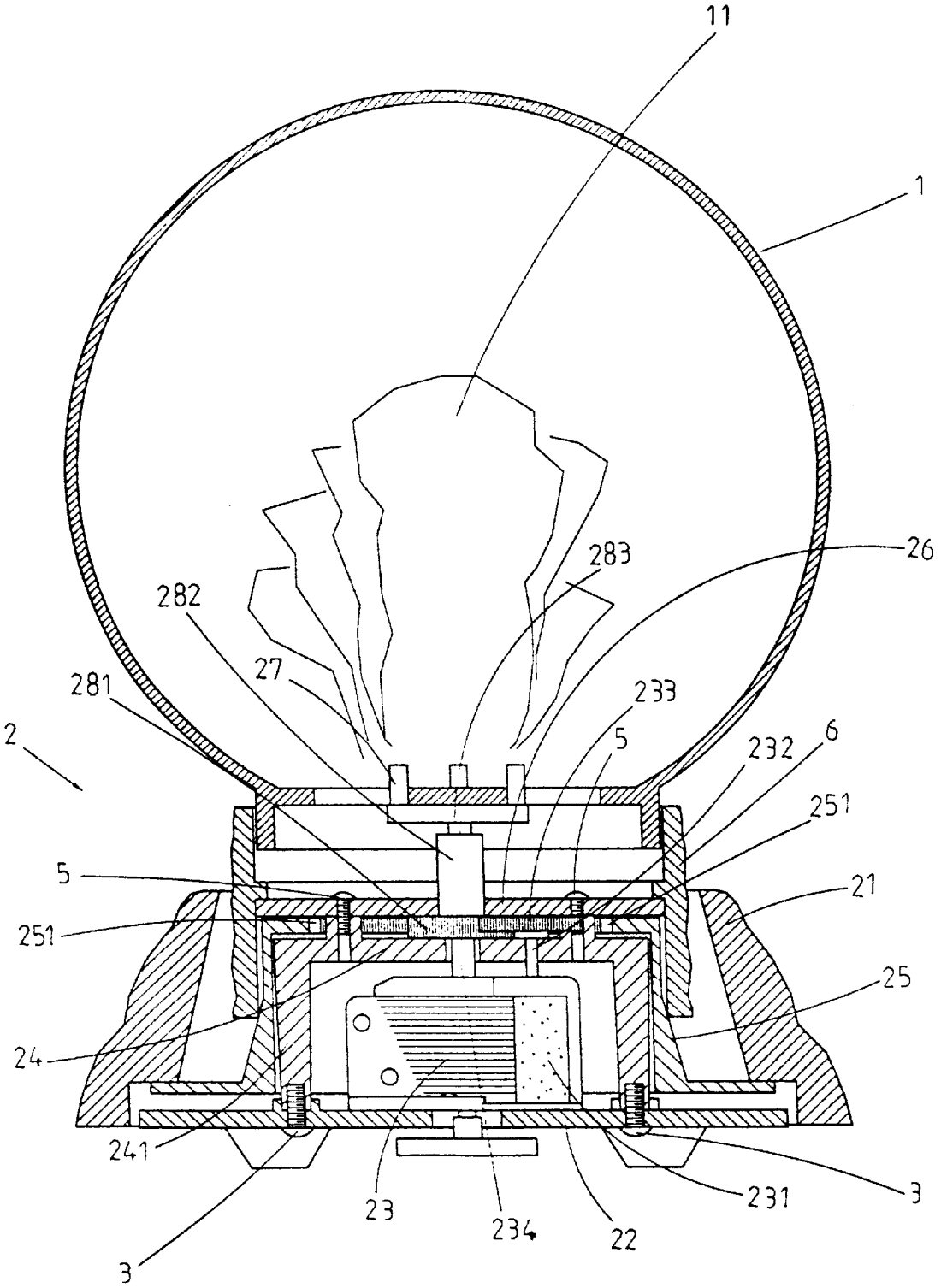
FIG. 4 is a sectional assembled view of the present invention.

Please refer to FIG. 1. The water ball structure of the present invention is similar to the conventional water ball product in appearance, including a water ball 1 and a base seat 2 assembled under the water ball 1. However, an internal view 11 of the water ball 1 and an external view 21 of the base seat 2 are variably rotatable relative to each other to create enhanced entertaining effect.

Please refer to FIGS. 2 to 5. In addition to the external view 21, the base seat 2 is composed of a disc-shaped base board 22, a music bell 23, a table-type support 24, a rotary tray 25, a pressing cover 26 and a transmission claw 27. The table-type support 24 is disposed with support legs 241 thereunder for riding and fixed on the base board 22 by screws 3. The music bell 23 is positioned between the support legs 241 and secured on the base board 22 by screws 4. A music roller 231 is disposed on one side of the music bell 23, having a transmission shaft 232 extending through the support 24 for outputting the rotational power of the music roller 231. A driving gear 233 is disposed at an upper end of the transmission shaft 232 above the support 24.

Figure 5:
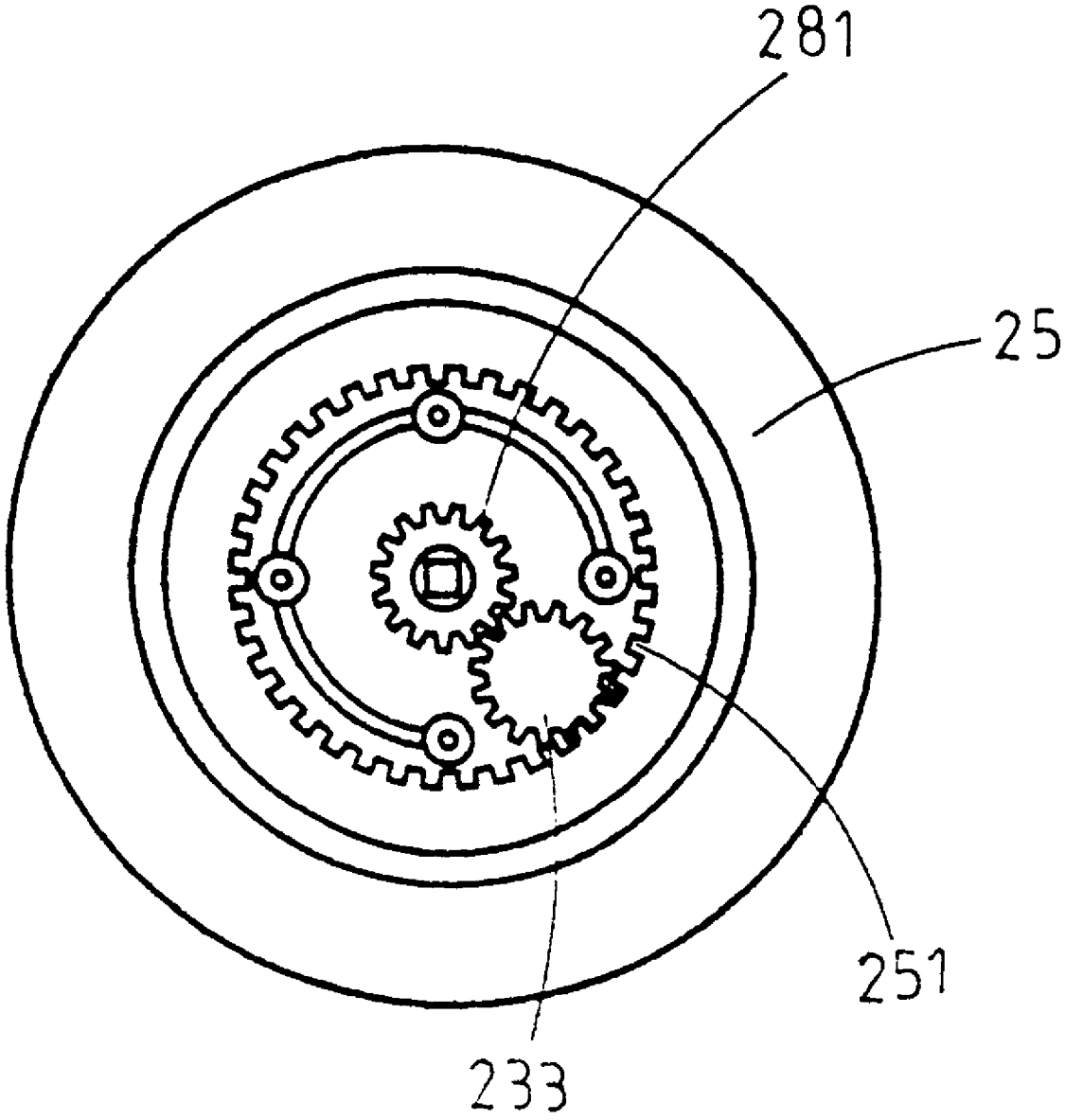
FIG. 5 is a top view showing the engagement between the gears of the present invention.

In addition, a power shaft 234 protrudes beyond the music bell 23 and is fitted with a center gear 28 which cooperates with the power shaft 234. A lower side of the center gear 28 is disposed with a driven gear 281. A central shaft 282 upward projects from the driven gear 281. A top end of the central shaft 282 is formed with a rectangular post 283 which is engaged with the transmission claw 27 for rotarily driving the same. The driven gear 281 meshes with the driving gear 233 (as shown in FIG. 5 ) so as to transmit the rotational power to the transmission claw 27.

In addition, the rotary tray 25 is fitted around the table-type support 24. The pressing cover 26 is secured on the support 24 by screws 5. A fitting ring 6 is fitted around a projecting boss of the rotary tray 25. The rotary tray 25 is a hollow body. The external view design 21 is fixed on outer circumference of the rotary tray 25 and rotatable along therewith. An inner gear 251 is disposed on inner circumference of the rotary tray 25. When the rotary tray 25 is fitted around the support 24, the inner gear 251 is right engaged with the driving gear 233 (as shown in FIG. 5 ) so as to transmit the rotational power to the external view 21.

By means of the cooperation between the inner and outer gears, the rotary tray 25 and the transmission claw 27 connected to the driven gear 281 are respectively driven to rotate in reverse directions. Accordingly, the internal view 11 of the water ball 1 driven by the transmission claw 27 and the external view 21 disposed on the base of the rotary tray 25 are rotated in reverse directions so as to create a double-directional rotation visual effect.

The present invention has simple structure and is manufactured at low cost. Also, the present invention has varied rotational directions so as to enhance the visual entertaining effect.

It is to be understood that the above description and drawings are only used for illustrating one embodiment of the present invention, not intended to limit the scope thereof. Any variation and derivation from the above description and drawings should be included in the scope of the present invention.

What is claimed is:

1. A double-directional rotary water ball structure comprising a water ball and a base seat disposed under the water ball, an internal rotary view being disposed in the water ball and an external view being disposed on an outer side of the base seat, wherein:

the base seat is composed of a disc-shaped base board, a music bell, a table-type support, a rotary tray, a pressing cover and a transmission claw, the table-type support being disposed with support legs thereunder for riding and fixed on the base board by screws, the music bell being positioned between the support legs and secured on the base board by screws, a music roller being disposed on one side of the music bell, having a transmission shaft extending through the table-type support, a driving gear being disposed at an upper end of the transmission shaft above the table-type support;

a power shaft protrudes beyond the music bell and is fitted with a center gear which cooperates with the power shaft, a lower side of the center gear being disposed with a driven gear, a central shaft projecting upward from the driven gear, a top end of the central shaft being formed with a rectangular post which is engaged with the transmission claw, the driven gear meshing with the driving gear so as to transmit rotational power to the transmission claw;

the rotary tray is fitted around the table-type support, the pressing cover being secured on the support by screws, a fitting ring being fitted around a projecting boss of the rotary tray, the rotary tray being a hollow body, the external view design being fixed on outer circumference of the rotary tray and rotatable along therewith, an inner gear being disposed on inner circumference of the rotary tray, whereby when the rotary tray is fitted around the support, the inner gear is right engaged with the driving gear so as to transmit the rotational power to the external view; and by means of the cooperation between the inner and outer gears, the rotary tray and the transmission claw connected to the driven gear are respectively driven to rotate in opposite directions, whereby the internal view of the water ball driven by the transmission claw and the external view disposed on the base of the rotary tray are rotated in opposite directions so as to create a double-directional rotation visual effect.

* * * * *